US007442404B2

(12) United States Patent
Kuroda et al.

(10) Patent No.: US 7,442,404 B2
(45) Date of Patent: Oct. 28, 2008

(54) ELECTRONIC DEVICE, ELECTRON SOURCE AND MANUFACTURING METHOD FOR ELECTRONIC DEVICE

(75) Inventors: Kazuo Kuroda, Kanagawa (JP); Noriaki Ohguri, Kanagawa (JP); Toshifumi Yoshioka, Kanagawa (JP); Takeo Tsukamoto, Kanagawa (JP); Yoshio Suzuki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 233 days.

(21) Appl. No.: 11/406,414

(22) Filed: Apr. 19, 2006

(65) Prior Publication Data

US 2006/0186781 A1 Aug. 24, 2006

Related U.S. Application Data

(62) Division of application No. 10/740,415, filed on Dec. 22, 2003, now Pat. No. 7,064,475.

(30) Foreign Application Priority Data

Dec. 26, 2002 (JP) ..... 2002-377085

(51) Int. Cl.
*B05D 5/12* (2006.01)
*B05D 3/02* (2006.01)

(52) U.S. Cl. ..... 427/74; 427/77; 427/299; 427/372.2

(58) Field of Classification Search ..... 427/74, 427/77, 299, 372.2
See application file for complete search history.

(56) References Cited

U.S. PATENT DOCUMENTS 4,904,895 A 2/1990 Tsukamoto et al. ..... 313/336
4,954,744 A 9/1990 Suzuki et al. ..... 313/336
5,847,495 A 12/1998 Yamanobe et al. ..... 313/310
5,986,389 A 11/1999 Tsukamoto ..... 313/310
6,019,657 A 2/2000 Chakvorty et al. ..... 445/24
6,147,449 A 11/2000 Iwasaki et al. ..... 313/495
6,171,162 B1 1/2001 Iwasaki et al. ..... 445/6
6,179,678 B1 1/2001 Kishi et al. ..... 445/24
6,184,610 B1 2/2001 Shibata et al. ..... 313/309
6,231,413 B1 5/2001 Tsukamoto ..... 445/24
6,246,168 B1 6/2001 Kishi et al. ..... 313/495
6,265,822 B1 7/2001 Kuroda et al. ..... 313/495
6,270,389 B1 * 8/2001 Kobayashi et al. ..... 445/24
6,288,494 B1 9/2001 Tsukamoto et al. ..... 315/169.1
6,472,814 B1 10/2002 Yamanobe et al. ..... 313/495
6,515,640 B2 2/2003 Tsukamoto et al. ..... 345/75.2

(Continued)

FOREIGN PATENT DOCUMENTS

EP 0 343 645 B1 10/1994

(Continued)

*Primary Examiner*—Brian K Talbot
(74) *Attorney, Agent, or Firm*—Fitzpatrick, Cella, Harper & Scinto

(57) ABSTRACT

To provide an antistatic film that requires low power consumption and provides satisfactory electric contact, as a measure for preventing an insulating substrate surface having an electronic device formed thereon from being charged. The electronic device includes: an insulating substrate; a conductor; and a resistance film connected with the conductor, the conductor and the resistance film being formed on the insulating substrate, characterized in that the resistance film has a larger thickness in a connection region with the conductor than a thickness in portions other than the connection region.

1 Claim, 10 Drawing Sheets

U.S. PATENT DOCUMENTS

| | | | | |
|---|---|---|---|---|
| 6,613,399 | B2 * | 9/2003 | Miyamoto et al. | 427/558 |
| 6,626,719 | B2 | 9/2003 | Ono et al. | 445/24 |
| 6,630,274 | B1 * | 10/2003 | Kiguchi et al. | 430/7 |
| 6,766,817 | B2 | 7/2004 | Silva | 137/1 |
| 6,777,868 | B1 | 8/2004 | Kosaka | 313/495 |
| 6,815,001 | B1 | 11/2004 | Mishima | 427/8 |
| 6,911,767 | B2 | 6/2005 | Takai | 313/311 |
| 2002/0031972 | A1 | 3/2002 | Kitamura et al. | 445/3 |
| 2002/0057045 | A1 | 5/2002 | Tsukamoto | 313/309 |
| 2002/0060516 | A1 | 5/2002 | Kawate et al. | 313/495 |
| 2002/0074947 | A1 | 6/2002 | Tsukamoto | 315/169.3 |
| 2002/0132041 | A1 | 9/2002 | Yamanobe et al. | 427/77 |
| 2003/0006684 | A1 | 1/2003 | Kawate et al. | 313/311 |
| 2003/0048055 | A1 | 3/2003 | Ishikura et al. | 313/311 |
| 2003/0048056 | A1 | 3/2003 | Kitamura et al. | 313/311 |
| 2003/0057860 | A1 | 3/2003 | Tsukamoto | 315/169.3 |
| 2004/0060477 | A1 | 4/2004 | Takashi et al. | 106/472 |
| 2004/0063839 | A1 | 4/2004 | Shinichi et al. | 524/439 |

FOREIGN PATENT DOCUMENTS

| | | |
|---|---|---|
| JP | 1-298624 | 12/1989 |
| JP | 8-180801 | 7/1996 |

* cited by examiner

DISTRIBUTION OF FILM THICKNESS WITHIN CELL ACCORDING TO EMBODIMENT 4

DISTRIBUTION OF FILM THICKNESS WITHIN CELL ACCORDING TO EMBODIMENT 5

ELECTRONIC DEVICE, ELECTRON SOURCE AND MANUFACTURING METHOD FOR ELECTRONIC DEVICE

This application is a division of U.S. application Ser. No. 10/740,415, filed Dec. 22, 2003, now U.S. Pat. No. 7,064,475, which issued on Jun. 20, 2006.

BACKGROUND OF THE INVENTION

1. Field of the Invention

The present invention relates to an electronic device such as an electron source formed on an insulating substrate and provided with a resistance film for preventing a surface of the insulating substrate from being charged.

2. Related Background Art

In recent years, a variety of electronic devices such as a semiconductor device and an electron-emitting device are utilized in various fields. Of those, an application of the electron-emitting device to an image display apparatus is being under study. The electron-emitting devices are roughly classified into two known types, i.e., one using a thermionic emission device and one using a cold cathode electron-emitting device. Examples of the cold cathode electron-emitting device include: a field emission type (hereinafter, referred to as FE type) device; a metal/insulating layer/metal type (hereinafter, referred to as MIM type) device; and a surface conduction electron-emitting device. The surface conduction electron-emitting device has a simple structure and is easy to manufacture. Thus, its application to the image display apparatus is greatly expected.

Those electronic devices are formed on the insulating substrate such as a glass substrate in some cases. In such cases, there arises a problem in that the surface of the insulating substrate is charged while the electronic device operates, so that operation conditions of the electronic device may be altered or become unstable. To solve the problem, disclosed in, for example, EP 343645 A (Japanese Patent Application Laid-Open No. 01-298624) and Japanese Patent Application Laid-Open No. 08-180801 is formation of a high-resistance electroconductive film on the insulating substrate surface.

The surface of the insulating substrate having the electronic device formed thereon is coated with a resistance film, making it possible to prevent the insulating substrate surface from being charged. Meanwhile, a current flowing through the resistance film causes an increase in total power consumption of the entire electronic device. In contrast, when placing an emphasis on a reduction in power consumption, the substrate is not sufficiently prevented from being charged. Thus, further improvements are required for achieving both the reduced power consumption and the prevention of the charging. In particular, in the surface conduction electron-emitting device having an electron-emitting region on the substrate surface, a shape of an antistatic resistance film in the electron-emitting region and its vicinities gives a large influence on electron-emitting characteristics. Thus, it is necessary to pay utmost attention to the formation of the resistance film. In addition, in the case of the surface conduction electron-emitting device, as described in the above publications, an energization operation called a forming process is carried out in forming the electron-emitting region. The inventors of the present invention have confirmed that the electron-emitting region is not formed favorably in this process, depending on the shape of the antistatic resistance film. As a result, an undesirable leak current is increased as well as an electron emission amount is decreased. Also, the above problem is not caused exclusively in the surface conduction electron-emitting devices, i.e., electron-emitting devices other than the surface conduction electron-emitting devices encounter the problem in some cases. Therefore, further improvements are demanded in this regard.

SUMMARY OF THE INVENTION

The present invention has been made with a view to solve the above-mentioned problems and an object of the present invention is therefore to provide a novel-structure of a resistance film formed on an insulating substrate surface and a manufacturing method therefor.

According to an aspect of the present invention, there is provided an electronic device such as an electron source, including: an insulating substrate; a conductor; and a resistance film connected with the conductor, the conductor and the resistance film being formed on the insulating substrate, in which the resistance film has a larger thickness in a connection region with the conductor than a thickness in portions other than the connection region.

Also, according to another aspect of the present invention, there is provided an electron source, including: an insulating substrate; an electron-emitting region; a conductor electrically connected with the electron-emitting region; and a resistance film connected with the conductor, the electron-emitting region, the conductor, and the resistance film being formed on the insulating substrate, in which the resistance film has a larger thickness in a connection region with the conductor than a thickness in portions other than the connection region.

Also, according to another aspect of the present invention, there is provided a manufacturing method for an electronic device substrate, including: forming a substrate whose surface has an insulating region and an electroconductive region; performing surface treatment on the substrate for reducing a contact angle in the electroconductive region to less than 80°; and forming a resistance film to extend over the electroconductive region and the insulating region of the substrate on which the surface treatment is performed.

Further, as a preferred embodiment of the present invention, there is provided a manufacturing method for an electronic device, specifically, an electron source, including: forming a plurality of electron-emitting devices and a plurality of porous wirings for driving the plurality of electron-emitting devices on a part of an insulating substrate; and applying an solution that contains electorconductive material or precursor onto a surface of the insulating substrate having the plurality of electron-emitting devices and the plurality of porous wirings formed thereon and drying the solution that contains electorconductive material or precursor to thereby form a resistance film extending over the plurality of porous wirings and the surface of the insulating substrate, in which the solution that contains electorconductive material or precursor is applied in an amount not smaller than a saturation point of solution absorption of the plurality of porous wirings.

DETAILED DESCRIPTION OF THE PREFERRED EMBODIMENTS

Figure 7:
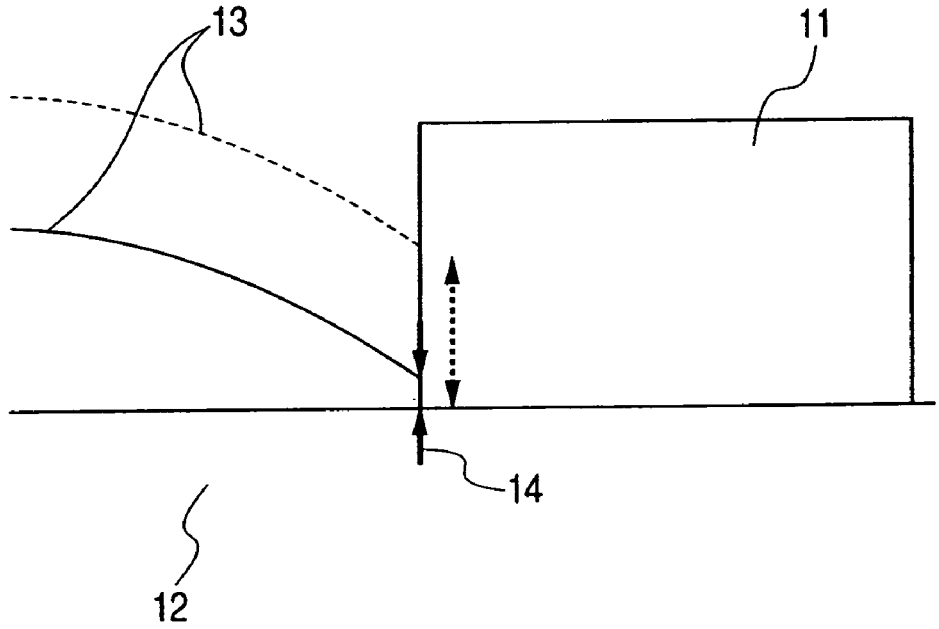
FIG. 7 illustrates a first example of an antistatic film used for explaining a problem thereof.
Figure 8:
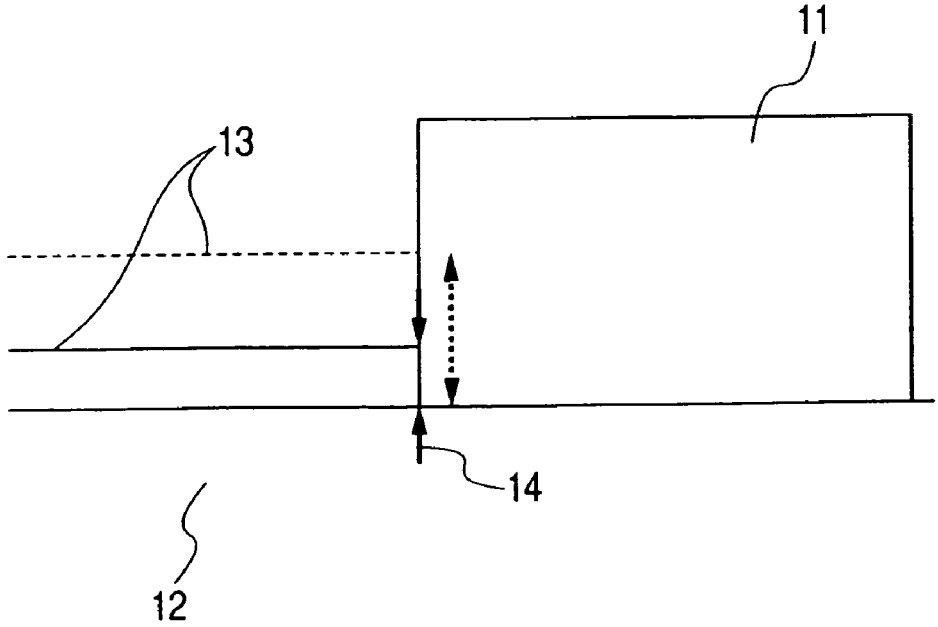
FIG. 8 illustrates a second example of the antistatic film used for explaining a problem thereof.
Figure 9:
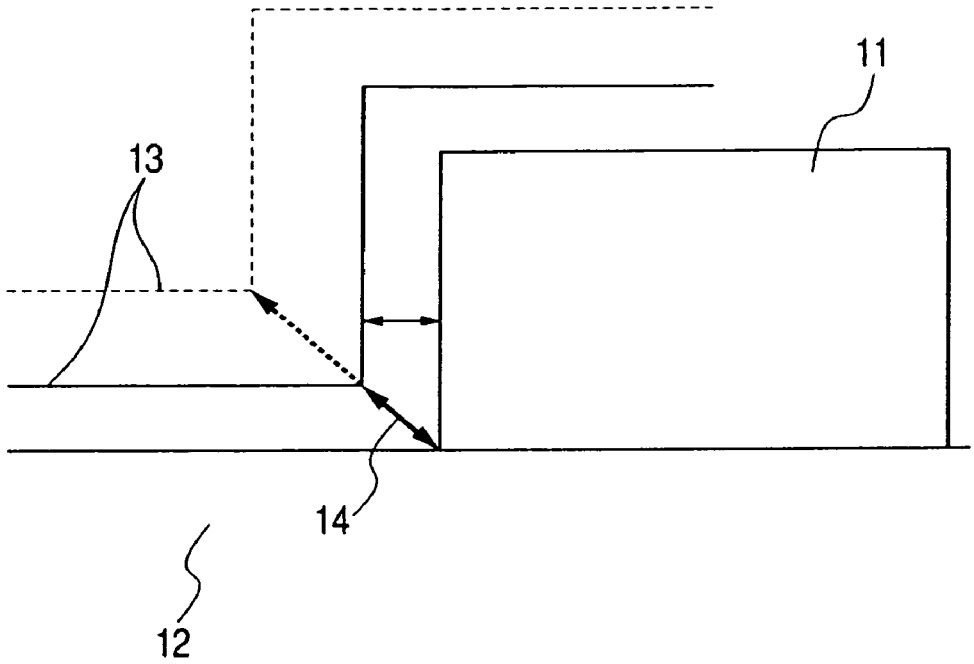
FIG. 9 illustrates a third example of the antistatic film used for explaining a problem thereof.
Figure 10:
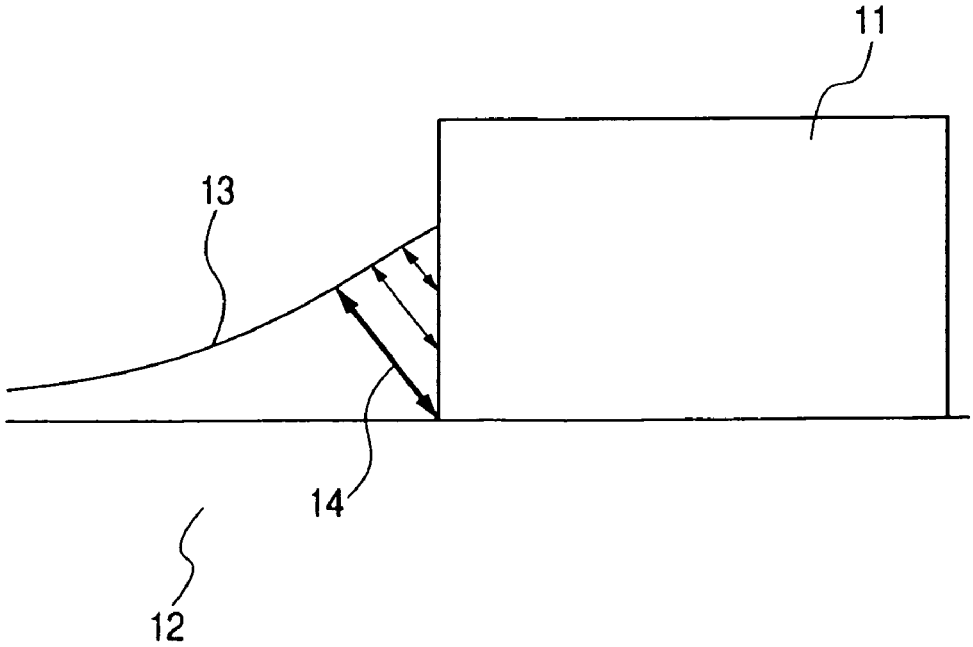
FIG. 10 illustrates an example of an antistatic film according to the present invention.

The present invention provides a novel structure related to a resistance film (antistatic film) for preventing an insulating substrate surface from being charged and a manufacturing method therefor. To elaborate, the invention provides an electronic device such as an electron source, including: an insulating substrate; a conductor; and a resistance film connected with the conductor, the conductor and the resistance film being formed on the insulting substrate, characterized in that the resistance film has a larger thickness in a connection region with the conductor than a thickness in portions other than the connection region. Accordingly, while sufficiently suppressing power consumption, it is possible to prevent the insulating substrate surface from being charged. More specifically, (1) an insulating surface desirably has a sufficiently high resistance for the purpose of suppressing the power consumption while preventing the charging, so that an extremely thin film is formed. In particular, in the case of the electron source having the electron-emitting devices on the insulating substrate, desirably, the resistance film covering the top of an electron-emitting region is extremely thin lest an electron emission should be inhibited. On the other hand, (2) because it is desirable that the connection region with the conductor have a resistance relatively low enough to enable sufficient electric conduction and have a mechanical strength sufficient to ensure that the resistance film is surely brought into contact with the conductor, a relatively thick film is formed therefor. Referring to FIGS. 7, 8, 9 and 10, the two items (1) and (2) will be explained. FIGS. 7, 8 and 9 show examples of the structure having no functions specified in the above items (1) and (2). In the figures, reference numeral 11 denotes a conductor; 12, an insulating substrate; 13, an antistatic resistance film; and 14, a thickness of the resistance film in the connection region with the conductor. In FIG. 7, the thickness of the resistance film in the connection region is smaller than that in the region where the resistance film covers an insulating surface. If the thickness of the resistance film is set so as to satisfy the above item (1) (solid line), a satisfactory electric connection cannot be attained. On the other hand, if the thickness of the resistance film is set so as to satisfy the above item (2) (broken line), the power consumption increases more than necessary. In addition, in FIGS. 8 and 9, the thickness of the resistance film in the connection region is the same as that in the region where the resistance film covers the insulating surface. Similarly to FIG. 7, structures of FIGS. 8 and 9 cannot meet conditions of both the above items (1) and (2). On the other hand, in FIG. 10 showing an example of the present invention, the resistance film has a larger thickness in the connection region than a thickness in the region where the resistance film covers the insulating surface. Therefore, it is possible to meet the conditions of both the above items (1) and (2), to ensure a contact condition with the conductor, with a high mechanical strength, and to attain the favorable electric connection with the conductor, and at the same time, to prevent the substrate from being charged while suppressing the power consumption. Note that the term thickness of the resistance film in the connection region with the conductor used herein means a thickness defined by bold-line arrows in each figure. In other words, it means a maximum distance among the shortest distances between an interface formed by the conductor and the resistance film and the resistance film surface. That is, in FIGS. 9 and 10, thicknesses defined by thin-line arrows correspond to the shortest distances between the interface formed by the conductor and the resistance film and the resistance film surface but do not represent the largest distance. Therefore, they do not correspond to the thickness of the resistance film in the connection region with the conductor as specified in the present invention.

Embodiment 1

Hereinafter, description will be made of the present invention by way of more specific examples.

Figure 1:
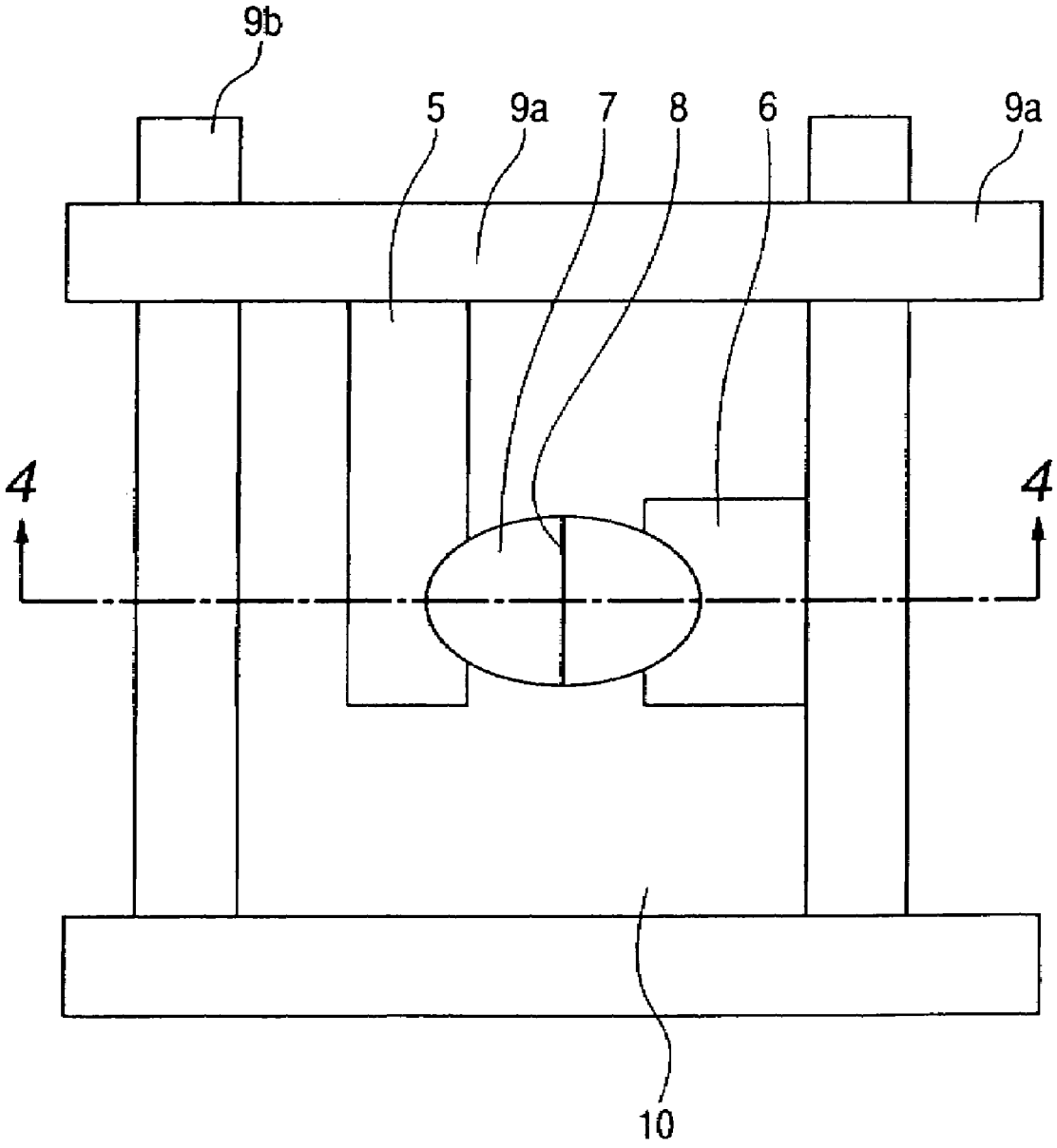
FIG. 1 is a partial bird's eye view showing an electron-emitting device according to the present invention.
Figure 2:
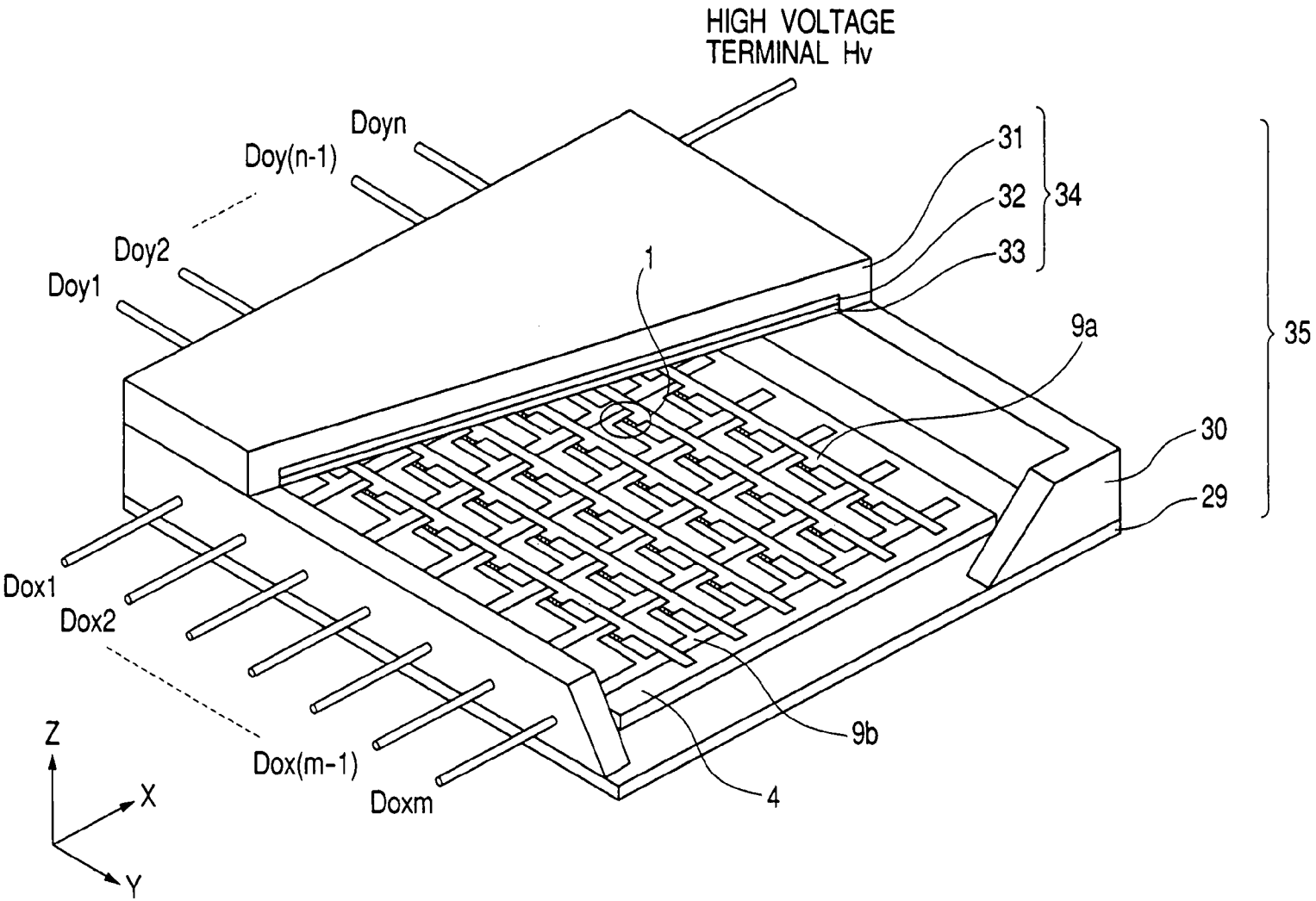
FIG. 2 is a schematic view showing an image display apparatus to which the present invention is applied.

A plurality of electron-emitting devices each having the same construction as that of FIG. 1 are arranged, as schematically shown in FIG. 2, on a base to constitute a display device. An electron source (denoted by reference numeral 4 in FIG. 2) having plural electron-emitting devices arranged in matrix is manufactured through procedures described below.

In FIG. 1, reference numeral 7 denotes an electroconductive thin film, and reference numerals 5 and 6 denote device electrodes. Reference symbols 9*a* and 9*b* denote X-direction wiring and Y-direction wiring, respectively.

It should be noted here that an insulating layer is formed in actuality between the Y-direction wiring and the X-direction wiring, but for the ease of understanding the construction, those components are partially omitted in the drawing.

Next, description is given of a specific manufacturing method.

(Step 1)

Soda lime glass is cleaned with a cleaning material and pure water, and then a pattern for the shapes of the device electrodes 5 and 6 is formed through a photolithography method.

Note that an interval between the device electrodes is set to 10 μm.

(Step 2)

Next, a pattern for the Y-direction wiring 9*b* is formed through a screen-printing method by using a paste material containing silver as a metal component (NP-4028A; manufactured by Noritake Co., Limited). Under the same conditions as those of Step 1, baking is performed to form the Y-direction wiring.

(Step 3)

After that, a paste functioning as a silicon oxide precursor is printed through the screen-printing method on a position where the X-direction wiring 9*a* is to be formed in a subsequent step, and an insulating layer for insulating the Y-direction wiring 9*b* and the X-direction wiring 9*a* from each other is formed thereon. Note that a section of the insulating layer above the device electrode 5 is partially cut out to achieve the connection between the device electrode 5 and the X-direction wiring 9*a* formed later.

(Step 4)

In the same manner as in Step 2, the X-direction wiring 9*a* is formed, thereby completing the wiring.

(Step 5)

Subsequently, the electroconductive thin film 7 is formed.

More specifically, a fine particle film composed of palladium oxide particles is formed as follows. Deposition of an organic palladium containing solution is performed so as to have a width of 200 μm by using an inkjet injection apparatus with the Bubble Jet (Registered Mark) method, followed by heat treatment at 350° C. for 10 min.

The resultant substrate obtained as described above then undergoes ultrasonic cleaning with a weak alkali cleaning solution. The cleaning solution used here is 0.4 wt % trimethyl ammonium hydride (TMAH). The ultrasonic cleaning is performed for 2 min.

After the cleaning, the substrate is rinsed in pure water in a flowing water replacement manner. Water attached to the substrate is removed by an air knife. Then, the substrate is dried in an oven at 120° C. for 2 min.

At this time, a contact angle of each section in the substrate 4 is measured. The measurement of the contact angle is performed by dropping water from a minute capillary tube, taking an image of the drop moment by a high-speed camera from the above, and observing a diameter of the droplet with the image. The contact angle can be found by the dropping amount and the droplet diameter. The contact angles thus found are shown in Table 1.

TABLE 1

| Location | Contact angle after cleaning (deg.) |
|---|---|
| Y-direction wiring | 10.2 |
| Insulating section | 12.2 |
| Device electrode | 10.6 |
| Device film | 11.0 |

After that, a surface of the substrate 4 is coated with a resistance film 10 in the following method.

As the resistance film 10, a film is prepared by dispersing oxide fine particles of tin oxide doped with antimony oxide in a 1:1 mixture of ethanol and isopropanol. The weight concentration of solid matters is set to about 0.1 wt %.

A spray method is used as the coating method. The coating is performed using a spray apparatus under conditions where a water pressure is 0.025 Mpa, an air pressure is 1.5 kg/cm$^2$, the distance between the substrate and a spray head is 50 mm, and the head movement velocity is 0.8 m/sec.

After the coating, ambient air baking is performed at 425° C. for 20 min. for stabilizing the film.

Next, a display device including the thus manufactured electron sources is constituted, which will be described with reference to FIG. 2.

The substrate 4 having a large number of the plane type surface conduction electron-emitting devices manufactured as described above is fixed on a rear plate 29, and thereafter a face plate 34 (constructed by forming a fluorescent film 32 and a metal back 33 on the inner surface of a glass substrate 31) is arranged at a position 5 mm above the substrate 4 via a support frame 30. A connection section of the face plate 34, the support frame 30, and the rear plate 29 is coated with frit glass, followed by baking in an ambient air or a nitrogen atmosphere at a temperature ranging from 400 to 500° C. for 10 min. or longer, thus seal-bonding the substrate.

The fixation of the substrate 4 to the rear plate 29 is performed using the frit glass.

In FIG. 2, reference numeral 1 denotes an electron-emitting device, and reference symbols 9*a* and 9*b* denote X-direction wiring and Y-direction wiring, respectively.

The fluorescent film 32 is formed of only a phosphor in the case of monochrome display. However, in this embodiment, a stripe-shaped phosphor is adopted. Black stripes are formed in advance, and gap sections between the stripes are coated with phosphors having various colors to form the fluorescent film 32.

As a material of the black stripe, there is used a material mainly containing black lead, which is often used in general.

A slurry method is used for the coating of the phosphor on the glass substrate 31.

The metal back 33 is provided to the inner surface side of the fluorescent film 32 in general.

The metal back is formed by, after the formation of the fluorescent film, performing Smoothing operation (which is generally called filming) on the inner surface side of the fluorescent film, and performing vacuum evaporation of Al.

In some cases, transparent electrodes (not shown) are provided on the outer surface side of the fluorescent film 32 to further improve an electroconductivity of the fluorescent film 32. However, in this embodiment, a sufficient electroconductivity can be obtained only by the provision of the metal back, and therefore the transparent electrodes are not provided thereon.

Upon the above-mentioned seal-bonding, a sufficient alignment is performed because the respective color phosphors and electron-emitting devices should be corresponded to each other in the case of color display.

An atmosphere within the glass container completed as described above is exhausted using a vacuum pump via an exhaust tube (not shown). After obtaining a sufficient degree of vacuum, a voltage is applied between the electrodes 5 and 6 of the electron-emitting device 1 via terminals Dxo1 to Doxm and terminals Doy1 to Doyn, which are provided externally to the container. The thin film 7 for forming an electron-emitting region is subjected to forming operation, thus preparing an electron-emitting region 8.

Figure 3A:
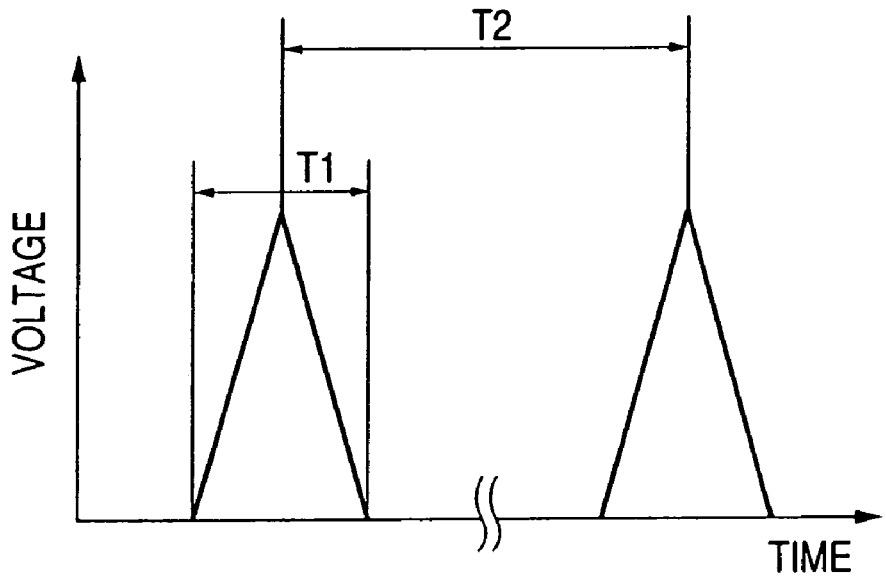
FIGS. 3A and 3B each illustrate a forming voltage waveform.
Figure 3B:
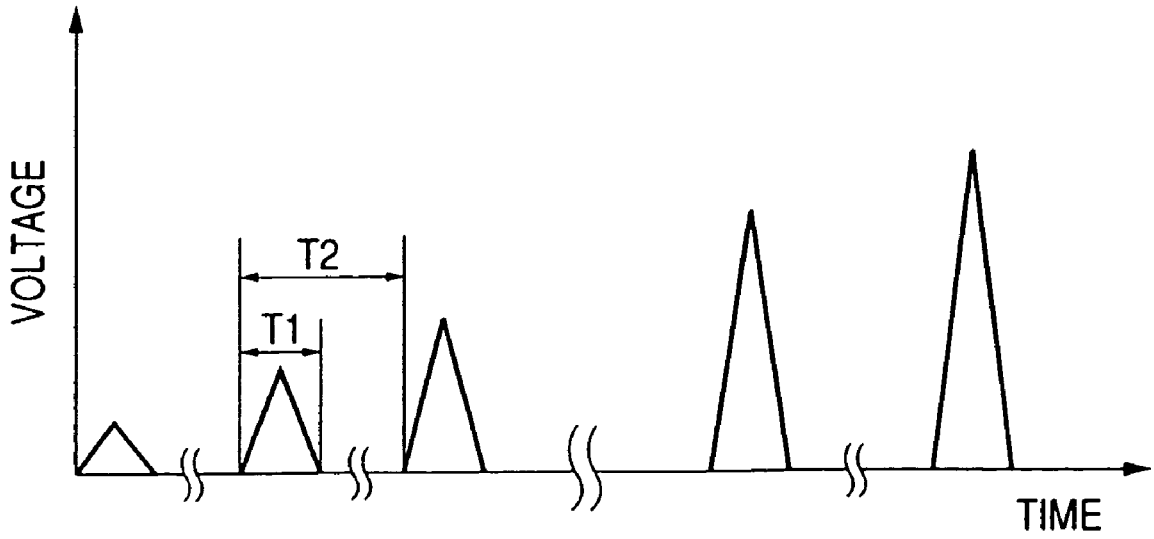

The above forming operation uses such a voltage waveform as shown in FIG. 3B.

In this embodiment, the forming operation is performed under a pressure of about $2\times10^{-3}$ Pa while T1 is set to 1 msec. and T2 is set to 10 msec. Note that a voltage waveform shown in FIG. 3 can be used for the above forming operation.

The electron-emitting region 8 prepared in this way is brought into a state where fine particles mainly containing palladium elements are dispersedly arranged. An average particle diameter of the fine particles is 3 nm.

Then, acetone is introduced into a panel from an exhaust tube of the panel via a slow leak valve to maintain a pressure of 0.1 Pa.

Subsequently, while a triangular pulse used in the above forming operation is changed into a rectangular pulse, a device current If (a current flowing between the device electrodes 5 and 6) and an emission current Ie (a current reaching (flowing into) an anode (metal back)) are measured at the pulse height of 14 V, thus performing activation operation.

The forming and activation operations are performed as described above, and the electron-emitting region 8 is formed, thus manufacturing the electron-emitting device.

In the energization forming and activation procedures, the electron-emitting device exhibit behaviors completely equivalent to those of an electron-emitting device of a comparative example having no coating of the resistance film 10.

It is conceivable that this is because a film thickness of the resistance film 10 coated on the electron-emitting device film is so small that the resistance film gives no effect to the device at all.

Then, evacuation is performed to obtain a pressure of about $10^{-6}$ Pa, and an exhaust tube (not shown) is heated by a gas burner to be welded, thus sealing an envelope.

Finally, getter processing is performed through a high-frequency heating method to maintain a degree of vacuum after the sealing.

In an image display apparatus 35 completed as described above according to this embodiment, each of the electron-emitting devices is applied with a scanning signal and a modulation signal outputted from a signal generation means (not shown) via the terminals Dxo1 to Doxm and the terminals Doy1 to Doyn, which are provided externally to the container, to thereby emit electrons. The metal back 33 or a transparent electrode (not shown) is applied with a high voltage having several kV or higher via a high voltage terminal Hv to accelerate electron beams. The electron beams are caused to collide against the fluorescent film 32 to come into an excitation and light-emitting state, whereby the image display apparatus displays an image.

As a result, stable images are displayed, no light beam deflections and the like occur, breaks etc. due to electric discharge are not observed, and extremely sharp images are obtained.

When Va is 10 kV, the emission current Ie of 3.0 μA/one device in average is obtained, an emission efficiency (Ie/If) is 2.6%, and an Ie dispersion a between devices is 5.6%, the values of which are satisfactory.

Figure 4A:
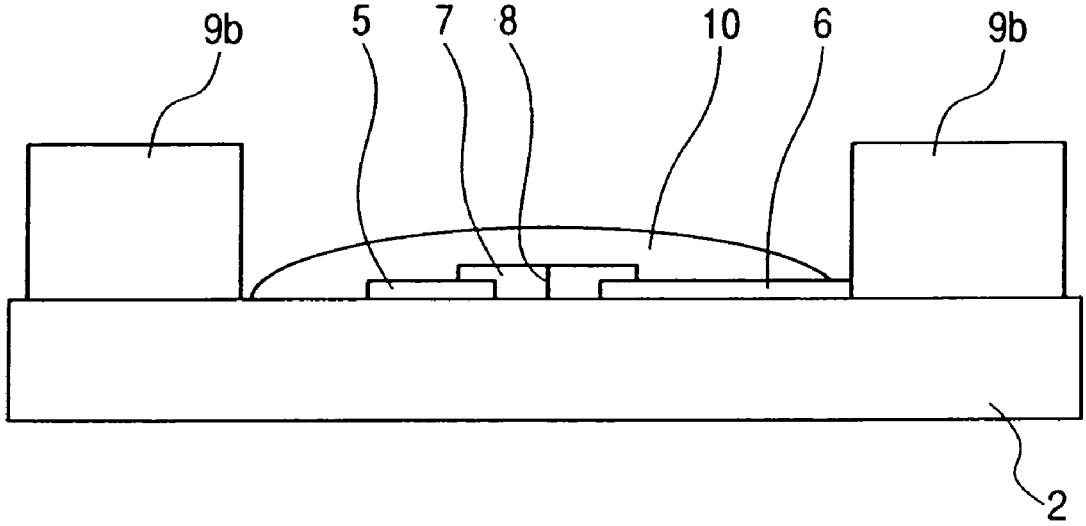
FIGS. 4A and 4B are partial sectional views of FIG. 1.
Figure 4B:
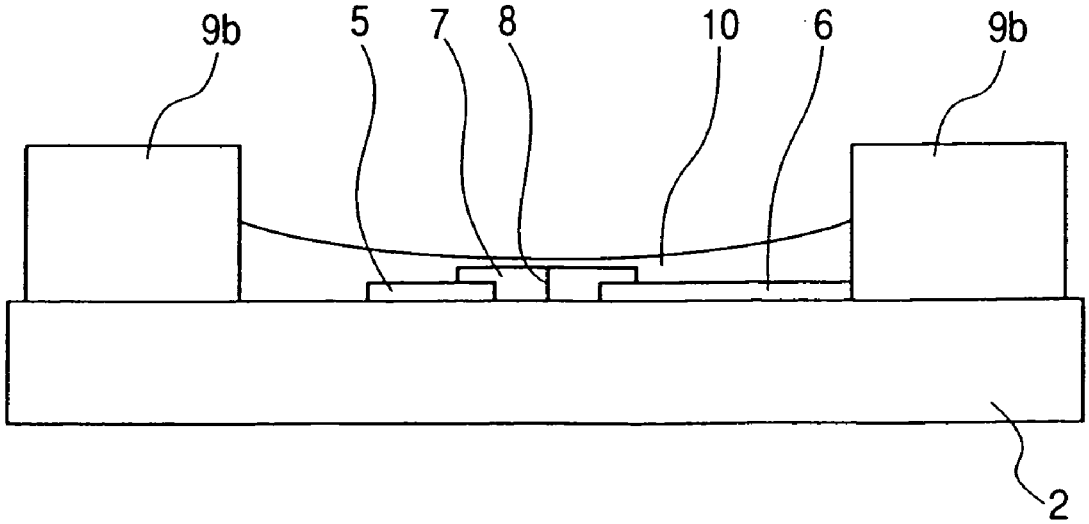

After that, the image display apparatus is disassembled, and coating configuration observation using SEM and coating film thickness analysis using cross section TEM are performed. As a result, a film thickness profile of the resistance film on a substrate 2 is revealed as shown in FIG. 4B. Note that FIG. 4B is a cross section taken along the line 4-4 of FIG. 1.

A film thickness of each section of the resistance film 10 is evaluated using the cross section TEM, the result of which is as follows (the film thickness values are approximate values).

TABLE 2

| Location | Film thickness (nm) |
|---|---|
| On Y-direction wiring | 55 |
| On insulating section | 32 |
| On device electrode | 25 |
| On device film | 25 |

In the case of the shape having four corners surrounded like a well as shown in the drawing, a profile of liquid existing therein generally has two modes, depending on a contact angle of a wall surface (electroconductive region in this case) with respect to the liquid. When the contact angle of the electroconductive region is 80° or smaller, the liquid and solid matters are basically attracted to each other owing to free energy generated on surfaces to attempt to reduce solid-liquid interfaces, thus forming a profile shown in FIG. 4B. On the contrary, when the contact angle of the electroconductive region is 80° to 90° or more, the liquid and solid matters are attracted less to each other. Then, a force for the liquid matters to solidify with each other becomes relatively large, thus forming a profile shown in FIG. 4A.

With such a mechanism, as shown in FIG. 4B, a section connected with the wiring has a thicker resistance film (antistatic film) than other sections. While sufficiently reducing the power consumption, the electric connection between the wiring and the antistatic film (resistance film) is therefore secured, and an antistatic function can be sufficiently obtained.

Embodiment 2

In Embodiment 2, an electroconductive paste containing silver is used for forming Y-direction wiring, and the number of organic polymer binder compositions is set larger than that of Embodiment 1. This wiring becomes porous after baking and then absorbs low viscosity liquid.

With such porous properties, when liquid is absorbed until saturation, affinity for the liquid becomes extremely high and thus droplets are not formed on the surface, whereby a surface having the contact angle of substantially 0° is formed.

In this embodiment, upon coating of the resistance film 10, a concentration of the solution is reduced to half as compared to Embodiment 1, but instead in order that the coating amount per unit area becomes double, the head movement velocity is halved to allow the coating amount to be larger than that the saturation point with respect to the absorbing amount of the wiring.

Specific conditions are as follows.

The resistance film 10 is obtained by dispersing oxide fine particles of tin oxide doped with antimony oxide in a 1:1 mixture of ethanol and isopropanol. The weight concentration of solid matters is set to about 0.05 wt %.

The spray method is used as the coating method. The coating is performed using a swirl spray apparatus manufactured by Nordson Corporation under conditions where a water pressure is 0.025 Mpa, an air pressure is 1.5 kg/cm$^2$, the distance between the substrate and a spray head is 50 mm, and the head movement velocity is 0.4 m/sec.

After that, an image display apparatus is manufactured following the same manufacturing procedures as those of Embodiment 1.

As a result, stable images are displayed, no light beam deflections and the like occur, breaks etc. due to electric discharge are not observed, and extremely sharp images are obtained.

When Va is 10 kV, the emission current Ie of 3.2 μA/one device in average is obtained, the emission efficiency is 2.9%, and the Ie dispersion σ between devices is 5.3%, the values of which are satisfactory.

After that, the image display apparatus is disassembled, and the coating configuration observation using the SEM and the coating film thickness analysis using the cross section TEM are performed. As a result, it is understood that the film thickness profile of the resistance film 10 on the substrate 2 is the same as that of Embodiment 1.

The film thickness of each section of the resistance film is as follows.

TABLE 3

| Location | Film thickness (nm) |
|---|---|
| Y-direction wiring | 60 (*) |
| Insulating section | 30 |
| Device electrode | 24 |
| Device film | 24 |

Note that an extremely large number of film components (oxide fine particles) are present on the Y-direction wiring surface, but it is difficult to define those components as a part of the film thickness because of their surface shape complexities. The film thickness values shown here are to be taken as only approximate values.

In this embodiment, the Y-direction wiring is porous and thus absorbs the coating liquid owing to capillary phenomenon. The capillary phenomenon satisfactorily develops when the contact angle is 90° or smaller, and more preferably, 80° or smaller. Under such a state, the Y-direction wiring having absorbed the liquid up to the saturation point has extremely high affinity for the liquid and forms a surface having a pseudo contact angle of 0°. Therefore, when the wiring is porous, the coating amount is equal to or larger than the saturation point, and also the coating profile shown in FIG. 4B can be developed in the case where the contact angle between the wiring material and the coating liquid is 80° or smaller.

In this embodiment as well, while sufficiently reducing the power consumption, the electric connection between the wiring and the antistatic film (resistance film) is secured, and the antistatic function can be sufficiently obtained.

Embodiment 3

The same assembly procedures as those in Embodiment 1 are generally performed in Embodiment 3.

Also, the coating conditions of the resistance film 10 are the same as those of Embodiment 1.

Before the formation of the resistance film 10, the insulating surface is subjected to hydrophobization processing using tetraethoxyorganosilane (TEOS).

To be specific, TEOS and the substrate are hermetically set within a chamber to stand for 2 min., thus performing gas phase absorption at a room temperature. After that, organic US cleaning using EtOH is performed for 5 min.

The contact angle of each section before the formation of the resistance film 10 is as follows.

TABLE 4

| Location | Contact angle after cleaning (deg.) |
|---|---|
| Y-direction wiring | 22.4 |
| Insulating section | 30.7 |
| Device electrode | 28.8 |
| Device film | 29.0 |

The coating conditions of the resistance film 10 are the same as those of Embodiment 1, and the assembly after the coating is performed in the same manner as in Embodiment 1.

Here, the completed image display apparatus forms an image.

As a result, stable images are displayed, no light beam deflections and the like occur, breaks etc. due to electric discharge are not observed, and extremely sharp images are obtained similarly to Embodiment 1.

When Va is 10 kV, the emission current Ie of 2.1 μA/one device in average is obtained, and the emission efficiency is 2.0%. In addition, the Ie dispersion σ between devices is 5.3%.

After the image formation, the image display apparatus is disassembled, and the profile of the resistance film 10 is observed similarly to Embodiment 1. As a result, the profile is the same, and the film thickness is substantially the same, as those of Embodiment 1

Embodiment 4

A manufacturing method for the electron source substrate 4 according to Embodiment 4 is described. The schematic construction is the same as those shown in FIGS. 1 and 4B.

(Step 1)

The substrate 2 having a silicon oxide film with a thickness of 1 μm formed on soda lime glass through a CVD method is cleaned with a cleaning material and pure water. Then, a pattern that becomes the device electrodes 5 and 6 and a gap between the electrodes is formed by means of photoresist (RD-2000N-41; manufactured by Hitachi Chemical Co., Ltd.), and 5 nm thick Ti and 100 nm thick Pt are sequentially deposited through a vacuum evaporation method.

The photoresist pattern is dissolved with an organic solvent to lift off the Pt/Ti deposition film and form the device electrodes 5 and 6 having an interval L between the device electrodes of 20 μm and a width W of the device electrode of 150 μm.

(Step 2)

Next, after application of screen print coating on the entire surface by use of a photoconductive paste material mainly containing Ag as a metal component, unnecessary sections are removed by patterning through the photolithography method. The patterned paste is baked under conditions where a peak temperature is 480° C. and a peak holding time is 10 min. by a heat treatment apparatus. Then, the Y-direction wiring 9*b* having a thickness of about 20 μm is formed. The wiring material thus formed through this method has porous properties.

(Step 3)

After the entire surface screen print coating application by use of a photoconductive paste material mainly containing PbO, patterning is performed through the photolithography method to remove unnecessary sections, followed by baking under the same conditions as those of Step 2. Thus, an interlayer insulating film is formed.

In this embodiment, this step is repeated for securing insulation stability. The insulating layer has a three-layer lamination structure with a thickness of 30 μm in average. The insulating layer is also porous similar to the above-mentioned Y-direction wiring 9*b*.

(Step 4)

An X-direction wiring 72 is formed using a photoconductive paste material mainly containing Ag as a metal component through the same method of Step 2. As in the above case, this wiring has the porous properties with a thickness of about 20 μm.

(Step 5)

Subsequently, the electroconductive thin film 7 is formed.

Specifically, an organic palladium-containing solution (ccp-4230, produced by OKUNO CHEMICAL INDUSTRIES CO., LTD) is applied to the center of a gap between the device electrodes 5 and 6 such that the electroconductive film 7 is formed with a width of 100 μm, by using an ink-jet ejecting device of a bubble jet (R) type.

After that, the heat treatment is performed at 350° C. for 10 minutes to obtain a fine particle film formed of palladium fine particles.

(Step 6)

Subsequently, the antistatic film (resistance film) 10 is formed.

While supplying a solution obtained by dispersing ultrafine particles of tin oxide (doped with antimony) in an organic solvent (mixture solution of isopropyl alcohol and n-butyl alcohol) by using a liquid pressure type one-fluid spray device, a spray nozzle is moved to apply the solution throughout the entire region to form the antistatic film 10.

In this embodiment, spray conditions are adjusted to set a spray amount to 100 ml/m$^2$, under which the solution is applied in an amount large enough to exceed the saturation point of solution absorption of the wiring.

To obtain the predetermined conductivity, it is necessary to adjust a concentration of the solid content that finally forms a film. In this embodiment, the concentration of the solid content is set to 0.1 wt %.

After the solution is applied with the spray, the substrate is subjected to the heat treatment at 380° C. for 10 minutes to stabilize the characteristics.

Figure 5:
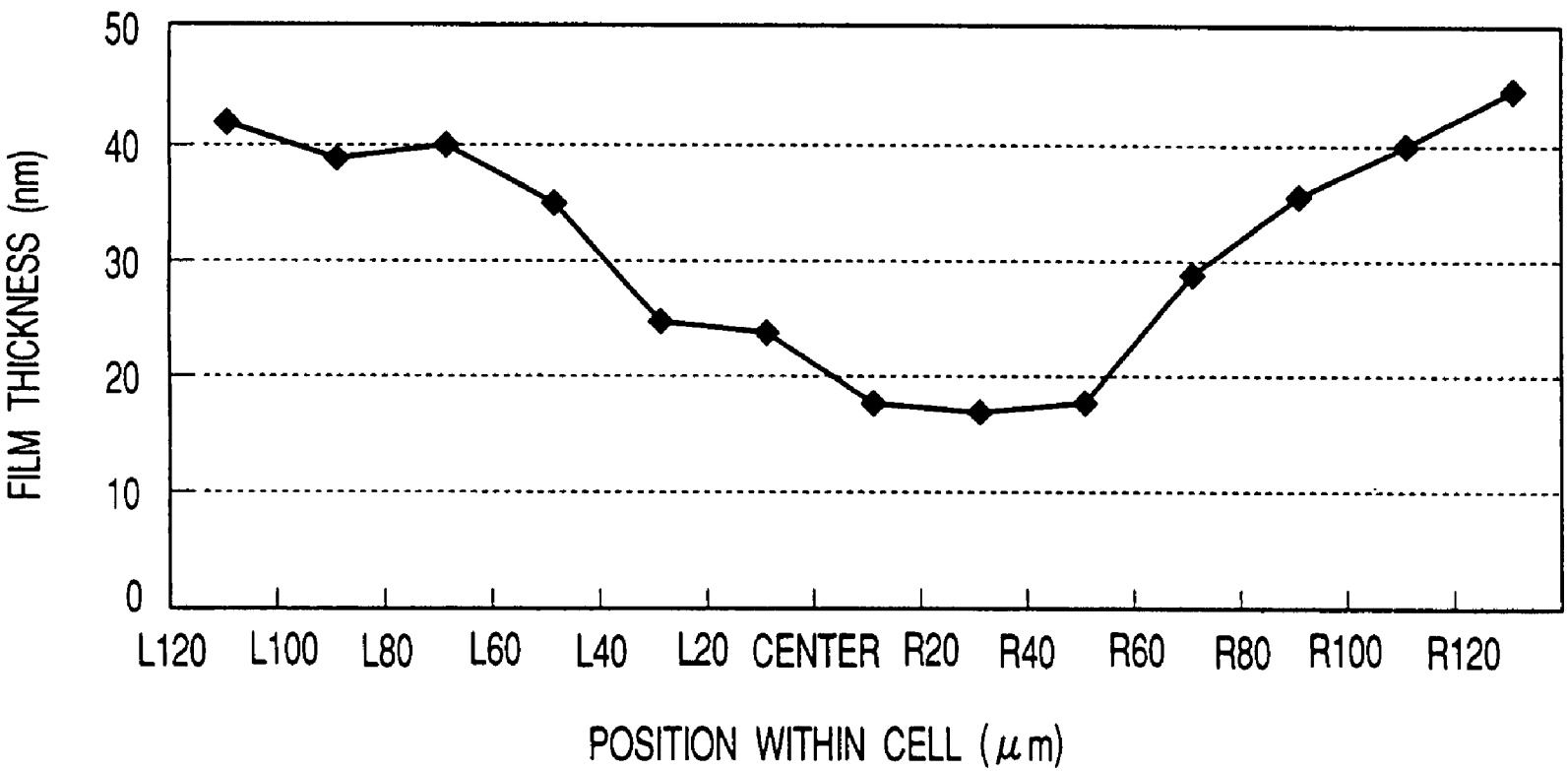
FIG. 5 illustrates distribution of film thickness of a resistance film according to Embodiment 4 of the present invention.

The characteristics of the electron-emitting device are evaluated, after which the substrate is broken and distribution of the film thickness within a cell is measured. FIG. 5 shows a typical example of measurement results.

As obvious from the measurement results of the film thickness distribution within the cell of the antistatic film 10 (portion surrounded by the wirings 9*a* and 9*b* of FIG. 1), the film thickness in the vicinity of the cell center where the electron-emitting region is formed can be reduced to ½ or less of the thickness in its periphery. The subsequent manufacturing method for the image display apparatus is the same as in Embodiment 1, and thus a repetitive description thereof is omitted here.

In this embodiment, the entire insulating surface of the substrate is coated with the antistatic film 10 made of a high-resistance electroconductive material and the charging caused by the electron emission is effectively avoided.

Further, according to the present invention, the thickness of the antistatic film above the electron-emitting region formed around the center can be made smaller than that in the periphery. Accordingly, there is no fear that the electron-emitting efficiency drops. Also, while sufficiently suppressing the power consumption, the electric connection between the wiring and the antistatic film (resistance film) is secured, thereby enabling the sufficiently high antistatic function. As a result, it is possible to emit the electrons from the electron-emitting devices with a high efficiency in a stable manner as well as to avoid the electron beam deflection caused by the charging and the breakage due to the discharge.

Embodiment 5

This embodiment differs from Embodiment 4 in that the organic solvent used in Step 6 of Embodiment. 4 is changed from n-butyl alcohol to ethyl alcohol, and an evaporation rate of the solvent component is increased.

The steps preceding or succeeding Step 6 are the same as in Embodiment 4, and thus a repetitive description thereof is omitted here.

Also in this embodiment, the substrate structure and the spray conditions are the same as in Embodiment 4.

Figure 6:
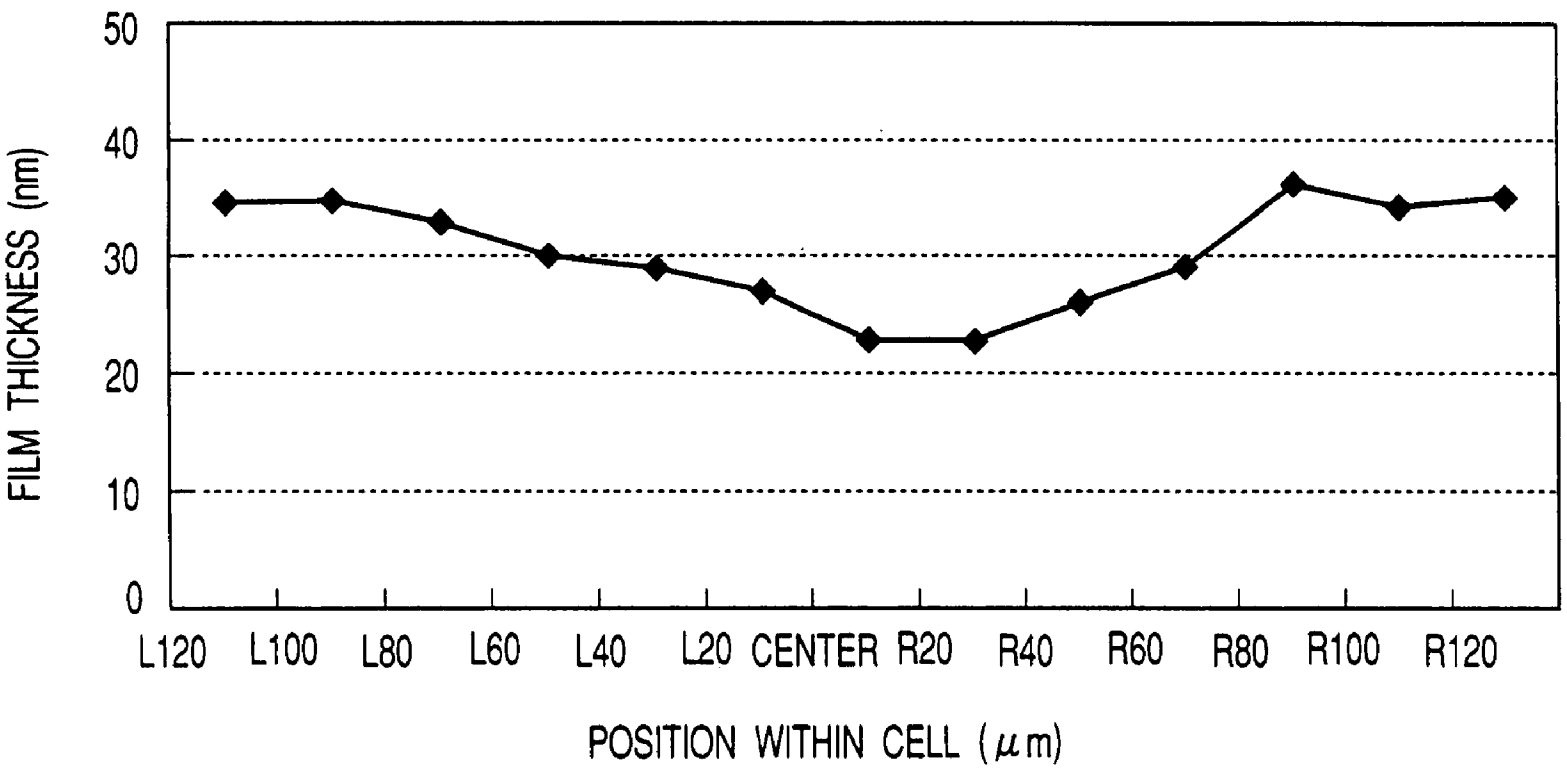
FIG. 6 illustrates distribution of film thickness of a resistance film according to Embodiment 5 of the present invention.

FIG. 6 shows a typical example of results of measurement of the film thickness distribution within the cell in the antistatic film formed in this embodiment, the measurement being performed by breaking the substrate.

By using the solvent whose evaporation rate is increased, the film thickness distribution difference between the center and the periphery is smaller than that of FIG. 5, but the effect of thinning the film in the center more than the periphery is obtained.

On the basis of this embodiment, it is confirmed that the present invention is not limited to the specific solvent component.

Also in this embodiment, the thickness of the antistatic film above the electron-emitting region formed around the center within the cell surrounded by the wirings is made smaller than that in the periphery, so that the electron-emitting efficiency does not drop. Also, while sufficiently suppressing the power consumption, the electric connection between the wiring and the antistatic film (resistance film) is secured, thereby enabling the sufficiently high antistatic function.

Hereinafter, a description will be given of an example where a hydrophobic film is formed on the electron-emitting region to cope with the film remaining uncut after the forming operation on the device film. A schematic structure thereof is the same as that of FIG. 1, so that a description will be made with reference to FIG. 1.

Step 1: As an insulating substrate, soda lime glass measuring 900×600 (mm) in size is used. The substrate is sufficiently washed with the organic solvent etc. and then dried at 120° C. On the substrate, the device electrodes 5 and 6 made of Pt are formed by using a vacuum deposition technique or a photolithography technique. At this time, a Pt film has a thickness of 500 Å and a distance L between the device electrodes 5 and 6 is 10 μm.

Step 2: Next, the silver photo-paste ink is used as the material for screen-printing, followed by drying. The resultant is subjected to light exposure into a predetermined pattern for development, and then baked at around 480° C. to form the Y-direction wiring 9*b* with a thickness of about 10 μm and a width of 50 μm.

Step 3: After that, the photosensitive glass paste mainly containing PbO is subjected to screen-printing and exposure/development in order, followed by baking at around 480° C. Thus, the interlayer insulating film having a contact hole open on a portion corresponding to the device electrode 5 is formed at a portion where the X-direction wiring 9*a* is to be formed. The interlayer insulating film has a thickness of 30 μm throughout the film and a width of 150 μm.

Step 4: Further, the Ag paste ink is screen-printed onto the insulating film and then dried. The same operation is performed thereon once more for double-coating. The resultant is baked at around 480° C. to form the X-direction wiring 9*a*. The X-direction wiring 9*a* crosses the Y-direction wiring 9*b* through the insulating film and comes into contact with the device electrode 5 through the contact hole formed in the insulating film.

With the wirings, the connection with the device electrode 5 is secured and the device electrode 5 functions as the scanning electrode after the whole is divided into panels. The thickness of the X-direction wiring is about 15 μm.

Step 5: Further, the treatment is performed for imparting the water repellency to the XY matrix substrate to some degree to adjust the water contact angle on the substrate surface to 65°.

Step 6: After that, the device film forming apparatus (ink-jet apparatus) is used to form the electroconductive film 7.

The used ink is the organic palladium-containing solution (aqueous solution containing 0.15 wt % of palladium-proline complex, 15% of isopropyl alcohol, 2.0% of ethylene glycol, and 0.05% of polyvinyl alcohol).

The solution is applied between the device electrodes dropwise by using the ink-jet ejecting device adopting a piezo device as the discharge head, while adjusting the dot size to 60 μm. After that, the substrate is baked under heating in the air at 350° C. for 10 minutes to obtain palladium oxide (PbO).

The average dot size of the obtained device film is 60 μm and the average film thickness thereof is 8 nm.

Step 7: Further, the same apparatus as the device film forming apparatus as mentioned above is used and the solution containing the hydrophobic thin film material is used as the ink for forming the hydrophobic thin film on the electroconductive film 7. The used ink is constituted of the aqueous solution containing isopropyl alcohol and dimethoxysilane (DDS) in a small amount. The dot size is adjusted to 65 μm. Thereafter, the heat treatment is performed at 130° C. for 10 minutes to obtain the hydrophobic thin film. The water contact angle on the hydrophobic thin film is adjusted to 70° to 80°.

Step 8: Subsequently, the spray coater is used to apply a solution, in which the ultra-fine particles mainly containing tin oxide are dispersed in the organic solvent (mixed solvent of n-butyl alcohol, ethanol, and water), over the entire substrate, while moving the spray nozzle, followed by a baking step etc. Thus, the antistatic film 10 is formed.

In this embodiment, an adjustment is made such that the average thickness of the antistatic film 10 is 30 nm and the sheet resistance is $10^{10}$ Ω/square upon spraying the solution. Thereafter, the heat treatment is carried out at 380° C. for 10 minutes to form the antistatic film 10.

Hereinafter, through the same steps as in Embodiment 1, the image display apparatus is manufactured.

The electron-emitting device manufactured by the manufacturing method of this embodiment as mentioned above is free of the problems that the device film 7 remains uncut in the forming step and that the leak current is caused due to the device film 7 partly remaining uncut. Accordingly, the variation in device characteristics is small.

Also, the insulating surface on the substrate is effectively coated with the antistatic film 10 made of the high-resistance electroconductive material to thereby prevent the substrate surface from being charged due to the electron emission. Thus, the electron-emitting characteristics of each electron-emitting device are extremely stable, and the image can be displayed in a stable manner without causing the deflection of the electron beam and the like and the breakage etc. due to the discharge.

As a result, the favorable image display apparatus can be obtained with a high yield.

Embodiment 6

A description will be given of a case where the antistatic film (resistance film) of the present invention is adapted to another structure of electron sources arranged in matrix. Note that the structures other than the electron source structure are the same as in Embodiment 1, and thus their repetitive description is omitted here.

Figure 11:
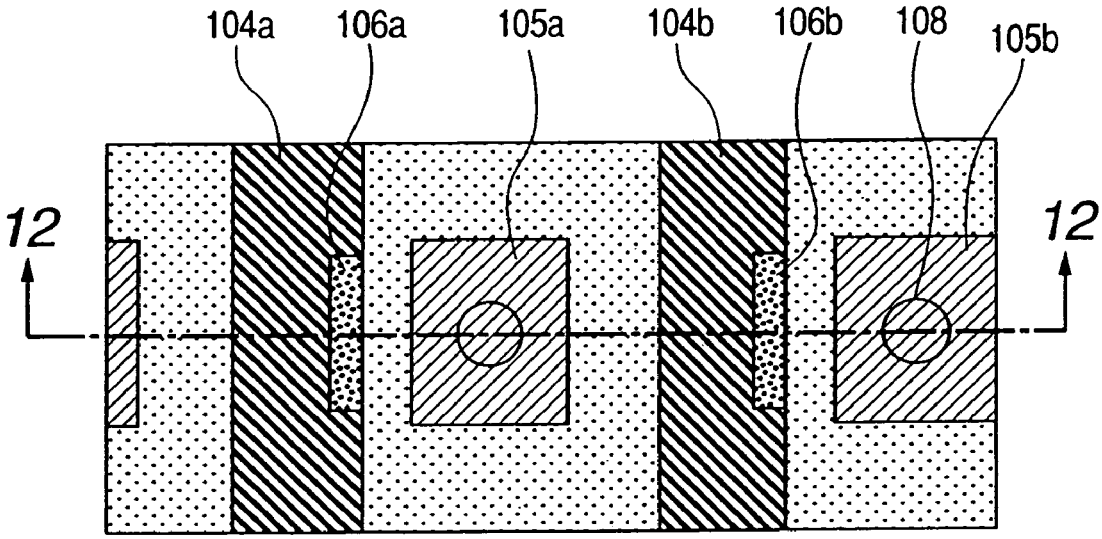
FIG. 11 illustrates an electron source structure according to Embodiment 6 of the present invention.
Figure 12:
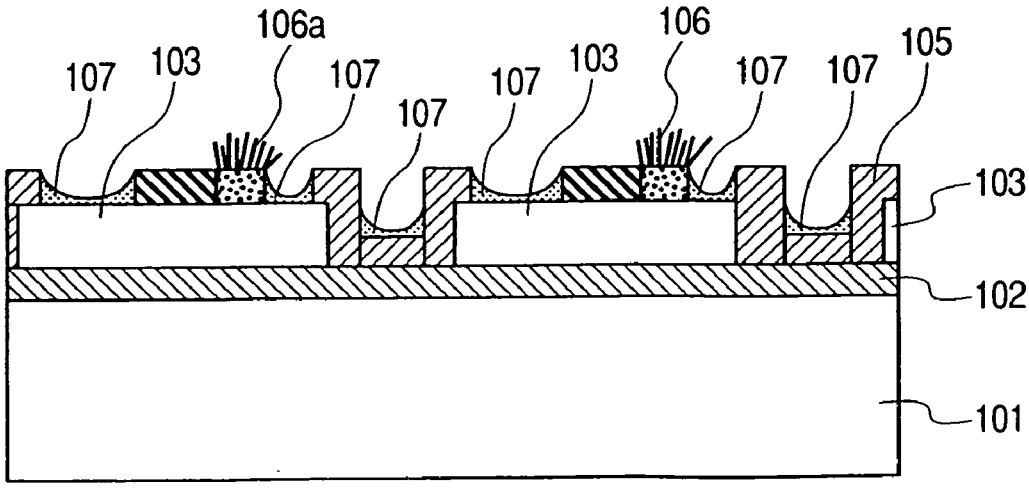
FIG. 12 illustrates a section taken along the line 12-12 of FIG. 11.

FIG. 11 is a plan view showing an arrangement on the substrate surface as viewed from above. FIG. 12 is a sectional view taken along the broken line 12-12 of FIG. 11. In FIGS. 11 and 12, reference numeral 101 denotes substrate glass; 102, a common wiring electrode (scanning wiring); 103, an interlayer insulating layer; 104*a*, 104*b*, common wiring electrodes (signal wirings); 105*a*, 105*b*, gate electrodes (extraction electrodes); 106, a carbon nanotube constituting the electron-emitting region; 106*a*, 106*b*, carbon nanotube aggregates; 107, an antistatic film of the present invention; and 108, a contact hole.

The manufacturing procedure is as follows in this embodiment.

1. The glass substrate (PD 200) 101 is used and ITO is deposited on the surface thereof with a thickness of 500 nm. The scanning common wiring electrode 102 is formed with a width of 600 μm by the photolithography technique.
2. Next, the solution for the interlayer insulating layer 103 mainly containing lead oxide and silica is applied with a thickness of about 10 μm, followed by the baking step. Thus, the interlayer insulating layer is formed.
3. Next, the contact hole 108 is formed in the interlayer insulating layer 103 with a diameter of about 150 μm by the photolithography technique.
4. The entire substrate surface is coated with chromium through the deposition with a thickness of about 1 μm. Following this, the common wiring electrodes (signal wirings) 104*a* and 104*b* and the gate electrodes (extraction electrodes) 105*a* and 105*b* are simultaneously formed with the photolithography technique.
5. The printing paste material containing the carbon nanotube 106 and appropriately containing the organic and inorganic materials, and the photosensitive organic material is applied and printed to form the carbon nanotube aggregates 106*a* and 106*b* constituting the electron-emitting region in a part of the common wiring electrodes 104*a* and 104*b*. After that, the photolithography is performed using the light transmitted through the substrate rear side for more finely shaping them.
6. The antistatic film is formed by the same method as in Embodiment 1.

With the method of the present invention, as understood from FIG. 12, the antistatic film 107 is set relatively thick in the connection region between the flat surface region and the end of the electrode (conductor) etc. as compared with the other portions, between the electrodes or within the contact hole. Accordingly, while suppressing the power consumption, the charging can be securely avoided.

In particular, in this embodiment, the structure of the present invention is applied to the portions between the electron source formation region 106*a* and the gate electrode 105*a* and between the electron source formation region 106*b* and the gate electrode 105*b*, and portions between the gate electrode 105*a* and the signal wiring 104*a* and between the gate electrode 105*b* and the signal wiring 104*b*.

In the case where the antistatic treatment is not performed on this device, if the given electron emission current is to be obtained, the beam spot position is varied as well as the drive voltage gradually increase with time. However, with the structure of this embodiment, the device can be driven at the given drive voltage. Also, the fluorescence spot position of the electron beam thus produced is not varied for a long period of time.

Embodiment 7

A description will be given of a case where the antistatic film (resistance film) of the present invention is applied to another structure of electron sources arranged in matrix. Note that the structures other than the electron source structure are the same as in Embodiment 1, and thus their repetitive description is omitted here.

Figure 13:
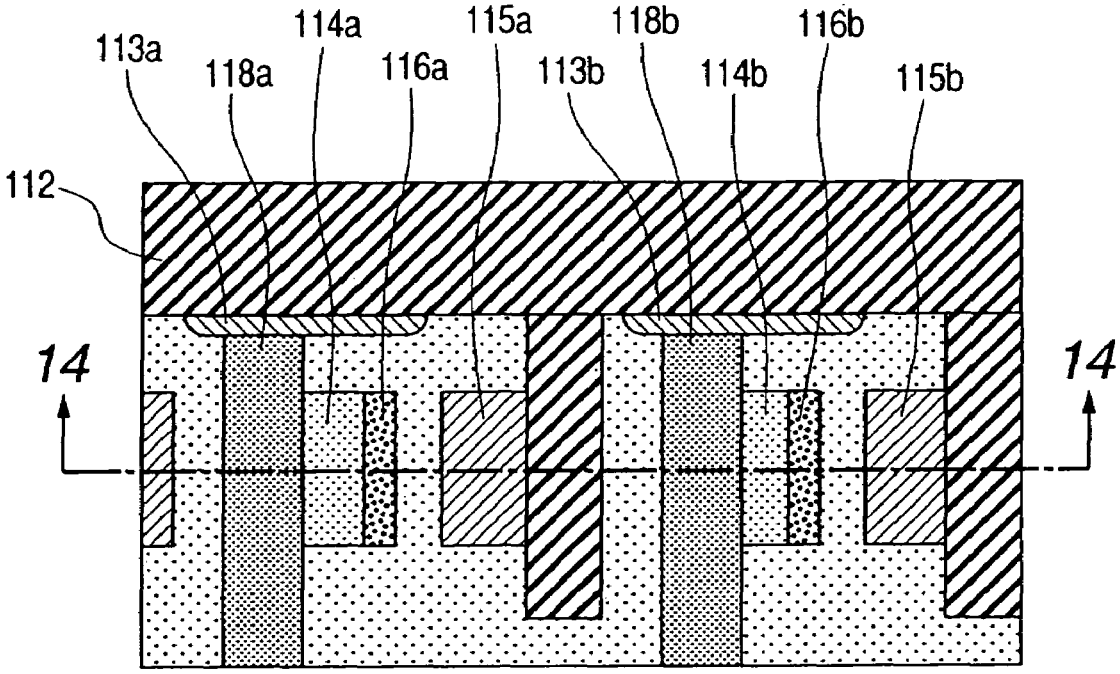
FIG. 13 illustrates an electron source structure according to Embodiment 7 of the present invention.
Figure 14:
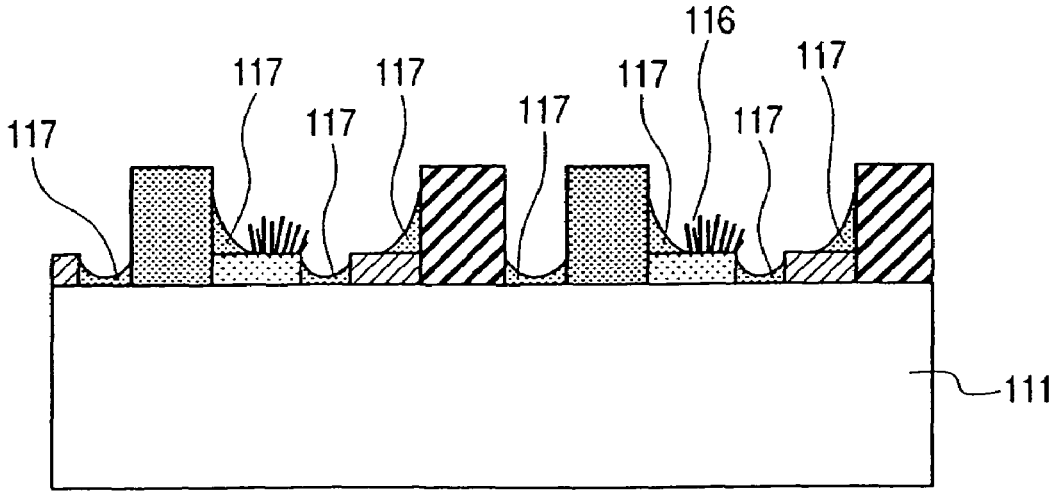
FIG. 14 illustrates a section taken along the line 14-14 of FIG. 13.

FIG. 13 is a plan view showing an arrangement on the substrate surface as viewed from above. FIG. 14 is a sectional view taken along the broken line 14-14 of FIG. 13. In FIGS. 13 and 14, reference numeral 111 denotes substrate glass; 112, a common wiring electrode (scanning wiring); 113, an interlayer insulating layer; 114*a*, 114*b*, cathodes; 115*a*, 115*b*, gate electrodes (extraction electrodes); 116, a graphite nanofiber constituting the electron-emitting region; 116*a*,

116*b*, graphite nanofiber aggregates; 117, an antistatic film of the present invention; and 118, a common wiring electrode (signal wiring).

The manufacturing procedure is as follows in this embodiment.

1. The glass substrate (PD 200) 111 is used and TiN is deposited on the surface thereof with a thickness of 100 nm. The cathodes 114*a* and 114*b* and the gate electrodes (extraction electrodes) 115*a* and 115*b* are simultaneously formed with the photolithography technique.
2. The silver printing paste is printed, followed by the baking step to form the common wiring electrodes (signal wirings) 118*a* and 118*b* with a thickness of about 1 μm.
3. The printing paste mainly containing lead oxide and silica is printed, followed by the baking step to form the interlayer insulating layers 113*a* and 113*b* with a thickness of about 20 μm.
4. The silver printing paste is printed, followed by the baking step to form the common wiring electrode (scanning line) 112 with a thickness of about 2 μm.
5. The catalyst ultra-fine particles including Pd—Co are dispersed and applied onto the cathode 114 and dry-etching is performed with Ar, thereby forming the catalyst in a part of the cathode.
6. The graphite nanofiber is produced at about 550° C. through the catalyst ultra-fine particles by low-pressure thermal CVD, using an acetylene gas and a hydrogen gas. As a result, the cathode regions 116*a* and 116*b* constituted of the graphite nanofiber aggregate are formed. Note that in this embodiment, the graphite nanofiber and the carbon nanotube differ in carbon hexagonal plane shape and are named differently.
7. Finally, the antistatic film is formed by the same method as in Embodiment 6.

Also in the structure of this embodiment, the antistatic film (resistance film) in any of the portions between the cathode and the gate electrode, between the electrodes formed by the printing technique, between the cathode and the printed wiring, and between the gate electrode and the printed wiring is set thick in the connection region with the electrode and the conductor such as the wiring as compared with the other portions.

As a result, similarly to Embodiment 6, it is possible to suppress an increase in the drive voltage and also the variation of the beam spot position.

According to the present invention, while sufficiently reducing the power consumption, the electric connection between the wiring and the antistatic film (resistance film) is secured, thereby enabling the sufficiently high antistatic function. Also, when the present invention is applied to the electron-emitting device as one of the electronic devices, while the satisfactory electron emission is realized, the power consumption is sufficiently reduced, and the electric connection between the antistatic film (resistance film) and the conductor such as the wiring is secured, thereby enabling the sufficiently high antistatic function.

What is claimed is:

1. A manufacturing method for an electronic device substrate, comprising:

forming a plurality of electron-emitting devices and a plurality of porous wirings for driving the plurality of electron-emitting devices on a part of an insulating substrate;

applying a solution containing electroconductive material or precursor onto a surface of the insulating substrate having the plurality of electron-emitting devices and the plurality of porous wirings formed thereon so that an amount of the solution is equal to or larger than a saturation point of the porous wiring; and drying the solution containing electroconductive material or precursor to thereby form an antistatic film extending over the plurality of porous wirings and the surface of the insulating substrate, so that the antistatic film has a thickness lesser than at a portion thereof on the electron-emitting device, and greater at a portion thereof connected with the porous wiring.

* * * * *